US005513574A

United States Patent [19]

Collins

[11] Patent Number: 5,513,574

[45] Date of Patent: May 7, 1996

[54] WALL MOUNTED TABLE APPARATUS

[76] Inventor: Harold O. Collins, 7551 E. North Ln., Scottsdale, Ariz. 85258

[21] Appl. No.: 334,273

[22] Filed: Nov. 4, 1994

[51] Int. Cl.[6] ..... A47B 3/083

[52] U.S. Cl. ..... 108/36; 108/48; 108/33; 108/70; 312/242; 312/248

[58] Field of Search ..... 108/42, 48, 38, 108/33, 35, 65, 69, 78, 70, 36; 312/242, 248, 314

[56] References Cited

U.S. PATENT DOCUMENTS

| | | | |
|---|---|---|---|
| 2,566,256 | 8/1951 | Snyder | 108/33 |
| 3,672,312 | 6/1972 | Pettit et al. | 108/69 |
| 4,155,609 | 5/1979 | Skaffe et al. | 312/314 X |
| 4,446,796 | 5/1984 | Wilson et al. | 108/69 |
| 4,646,654 | 3/1987 | Sullivan | 108/69 |
| 4,693,187 | 9/1987 | Bisbing | 108/65 |
| 4,750,432 | 6/1988 | McNamara et al. | 108/69 |

*Primary Examiner*—Jose V. Chen
*Assistant Examiner*—Rodney B. White
*Attorney, Agent, or Firm*—H. Gordon Shields

[57] ABSTRACT

Folding table cabinet apparatus includes a base cabinet with a pair of folding doors secured to a base cabinet. Within the base cabinet is a table assembly. The table assembly is pivotally secured within the cabinet and is held therein by a pair of lock plates. The table assembly pivots outwardly from the cabinet and is supported by a pair of folding legs. The table includes two plates, a main table plate and an outer end extension or leaf plate which is pivotally secured to the main table plate. The extension or leaf plate is held in alignment with the main plate by a pair of slider elements which are pinned to the main table plate.

2 Claims, 3 Drawing Sheets

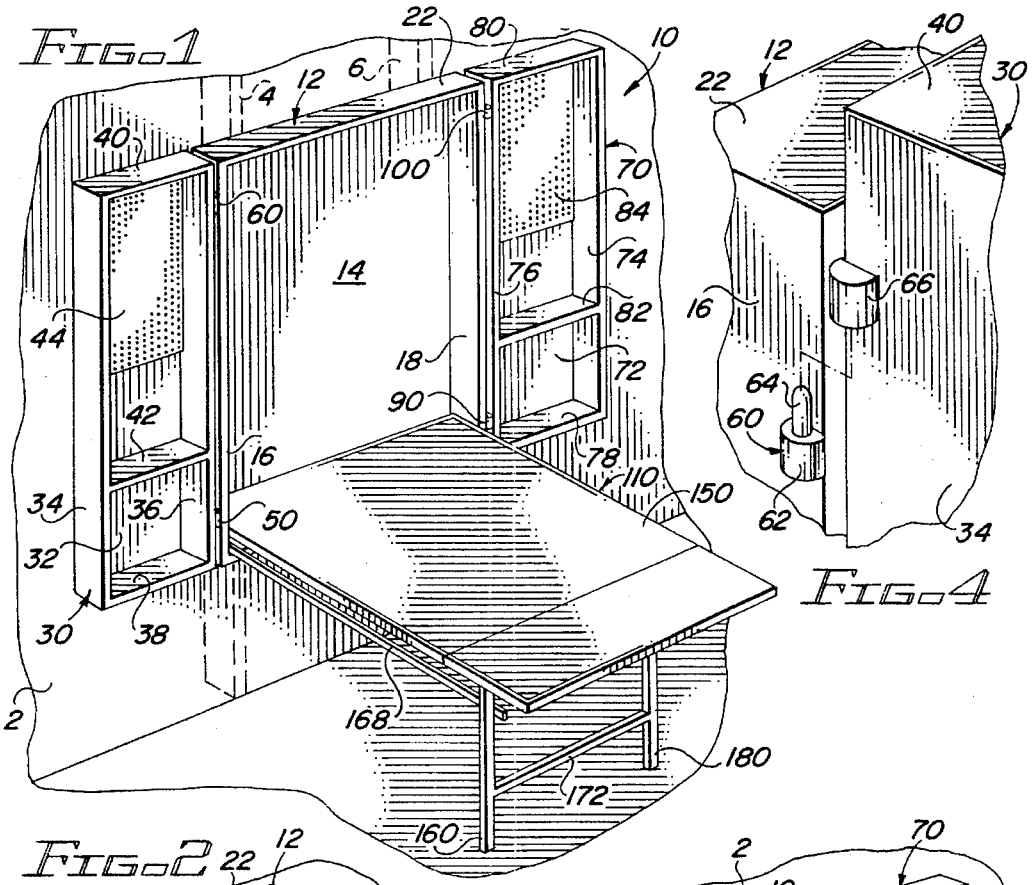
FIG. 4
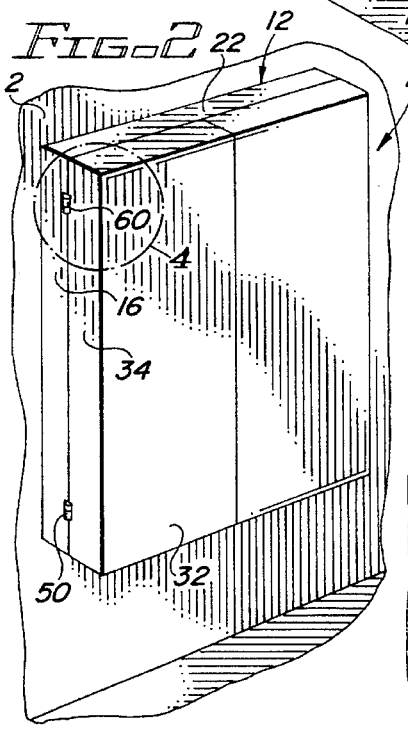
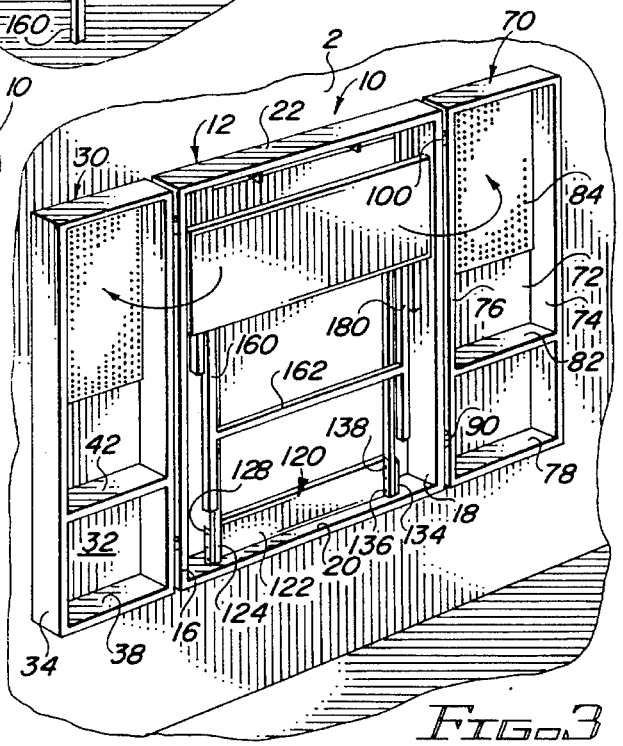
FIG. 3

WALL MOUNTED TABLE APPARATUS

BACKGROUND OF THE INVENTION

1. Field of the Invention

This invention relates to wall mounted table apparatus, and more particularly, to a table mounted in a cabinet secured to a wall.

2. Description of the Prior Art

U.S. Pat. No. 694,312 (Barber) discloses a portable work bench disposed in a cabinet. The cabinet opens on two sides to allow the work bench to pivot downwardly to its use position.

U.S. Pat. No. 880,185 (Beverly) discloses a kitchen cabinet which includes a table which folds downwardly. The table includes an extension leaf which is pivotally secured to a main table by a pair of hinges.

U.S. Pat. No. 1,213,832 (Brandt) discloses another type of folding table secured to a cabinet. Again, the main table platform pivots away from the cabinet. Included in the apparatus are braces for the table legs. The braces are secured to the cabinet and the table leg.

U.S. Pat. No. 1,703,187 (Buck) discloses a combination table and ironing board, with the ironing board telescoping within the table and with the legs of the ironing board folding against the ironing board for storage purposes.

U.S. Pat. No. 4,155,609 (Skafte et al) discloses a wall hung cabinet arrangement with a table folding into the cabinet for storage purposes and pivoting outwardly and downwardly for use. Braces are secured to the legs and to the cabinet.

The apparatus of the present invention includes a leaf or extension which pivots relative to the main table portion and is held in place by a sliding flange which is cammed upwardly to maintain the leaf in alignment with the main table portion. The table apparatus is held in the cabinet in its storage position by a pair of lock elements which are gravity actuated to hold the apparatus in the stored position.

SUMMARY OF THE INVENTION

The invention described and claimed herein comprises table apparatus pivotally secured to a cabinet, and the cabinet is in turn secured to a wall. The table includes two portions, a main table portion and an extension leaf which pivots on the main table portion. The extension is supported in alignment with the main table portion through a slider support. The slider support includes an angled slot which cams or biases the slider support against the table for alignment purposes. A pivoting lock element is used to hold the table in the cabinet in the up or stowed position for storage purposes. The lock element must be manually raised in order to raise the table. However, when the table is folded, the lock element is cammed to allow the table to be completely folded. When the table is in the folded and up position, the lock element falls into position by gravity to hold the table in the up position.

BRIEF DESCRIPTION OF THE DRAWING

FIG. 1 is a perspective view of the apparatus of the present invention in its down or use position with the cabinet opened fully.

FIG. 2 is a perspective view of the apparatus of FIG. 1 showing the cabinet closed, with the table apparatus disposed therein.

FIG. 3 is a perspective view sequentially following FIG. 2 illustrating the opening of the cabinet but with the table in the up, storage position.

FIG. 4 is an enlarged perspective view taken generally from circle 4 of FIG. 2.

DESCRIPTION OF THE PREFERRED EMBODIMENT

Figure 5:
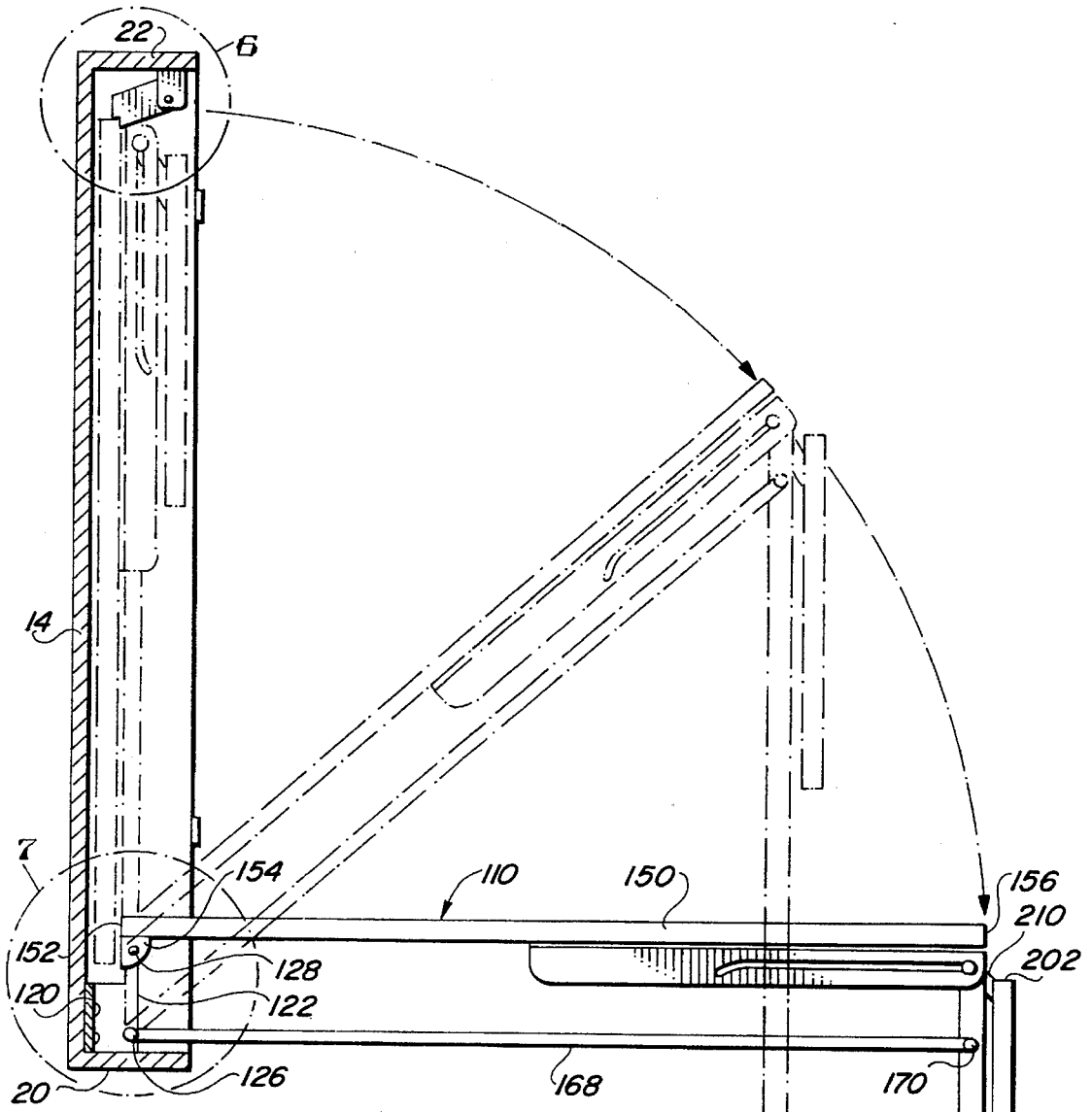
FIG. 5 is a side view sequentially illustrating the downward pivoting of the table from the up, storage position.

FIG. 1 is a perspective view of cabinet and table apparatus 10 of the present invention secured to a wall 2. Within the wall 2 are two wall studs including a stud 4 and a stud 6, both of which are shown in phantom.

The apparatus 10 includes a base cabinet 12. The cabinet includes two doors, a door 30 and a door 70. The base cabinet 12 includes a back 14, a pair of sides 16 and 18, a bottom 20 and a top 22. The cabinet is relatively shallow, but the height, width, and depth of the cabinet are sufficient to enclose table apparatus 10.

FIG. 2 is a perspective view of the apparatus 10 secured to the wall 2, with the doors 30 and 70 closed. FIG. 3 is a perspective view of the apparatus 10 showing the doors 30 and 70 of the cabinet opened, with table apparatus 10 disposed therein. For the following general discussion, reference will primarily be made to FIGS. 1, 2, and 3.

The doors 30 and 70 are substantially identical, and they are hingedly secured to the sides 16 and 18 of the base cabinet 12. The door 30 includes a panel 32 secured to a pair of sides 34 and 36. The door 30 also includes a bottom 38 and a top 40. The two sides 34 and 36, the bottom 38, and the top 40 are all appropriately secured to the panel 32.

Within the door 30, as shown in FIGS. 1 and 3, is a shelf 42 and a pegboard panel 44. The shelf 42 is spaced upwardly from the bottom 38.

The door 70 includes a panel 72 to which are secured a side 74, a side 76, a bottom 78, and a top 80. The door 70 also includes a shelf 82 and a pegboard panel 84. Again, the shelf 82 is spaced upwardly from the bottom 78, and the pegboard 84, like the pegboard 44, is disposed in the upper portion within the door.

The doors 40 and 70 are hingedly secured to the sides 16 and 18 by hinges 50, 60 and 90, 100, respectively. The hinges 50, 60, 90, and 100 are substantially identical to each other. The arrangement of the hinges is illustrated in FIG. 4. FIG. 4 comprises a perspective view of the door 30 separated from the base cabinet 12, and taken generally from circle 4 of FIG. 1. The hinge assembly 60 includes a base element 62 which is secured to the side panel 16. Extending upwardly from the base element 62 is a pin 64. A socket 66 is secured to the side panel 34 of the door 30. In FIG. 4, the door 30 is shown raised slightly away from the base cabinet 12.

Figure 6:
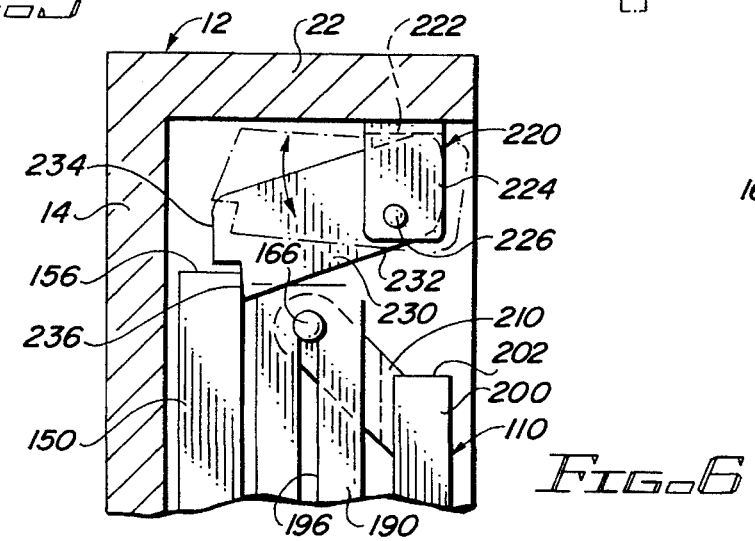
FIG. 6 is an enlarged view taken generally from circle 6 of FIG. 5.
Figure 7:
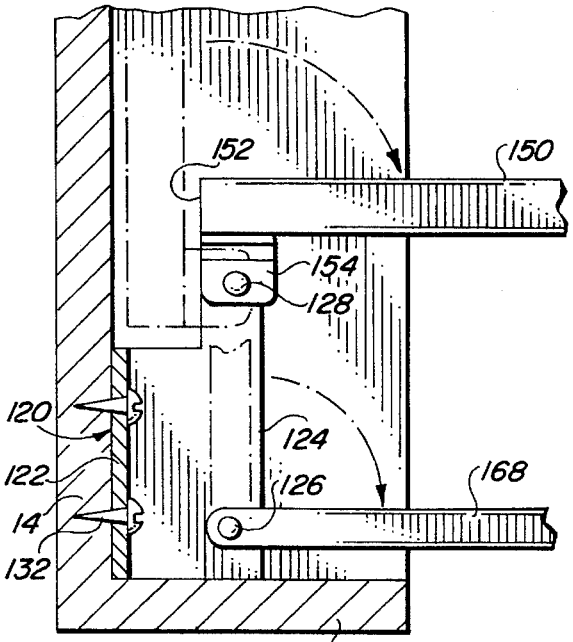
FIG. 7 is an enlarged view taken generally from circle 7 of FIG. 5.

Disposed within the base cabinet 12 is table apparatus 110. The table apparatus 110 is shown in its up or stored position in FIG. 3, and in its down, open position in FIG. 1. FIG. 5 is a side view of the table apparatus 110, illustrating the movement of the table 110 from its up, storage or stowed position in the base cabinet 12 to its down, open position. An intermediate position of the table 110 is shown in dash/dot line in FIG. 5. FIG. 6 is a side view of the table 110 within the base cabinet 12 in the up position, held in place by a lock assembly 220. FIG. 6 is generally an enlarged view taken from circle 6 of FIG. 5. FIG. 7 is an enlarged view of the lower portion of the base cabinet 12 illustrating the securing of the table 110 to the base cabinet 12. FIG. 7 is taken generally from circle 7 of FIG. 5.

Figure 9:
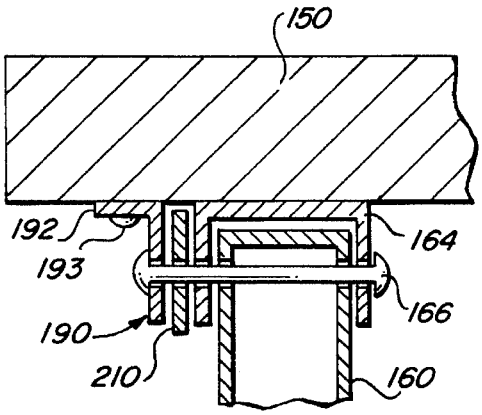
FIG. 9 is a view in partial section taken generally along line 9—9 of FIG. 8A.
Figure 8A:
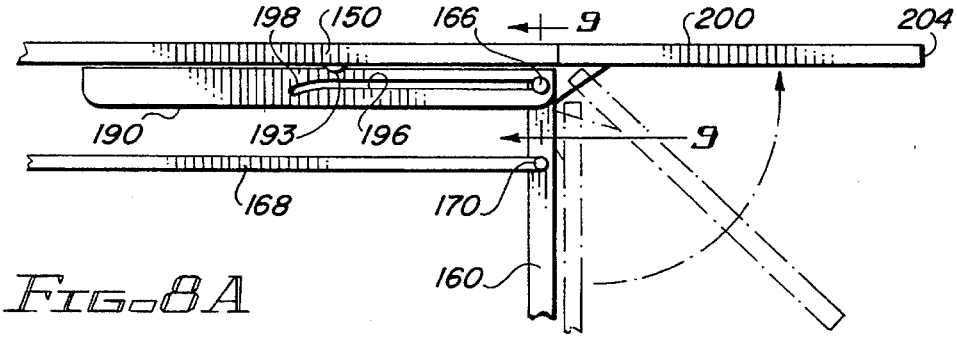
FIG. 8A is a side view illustrating the raising of the extension leaf.
Figure 8B:
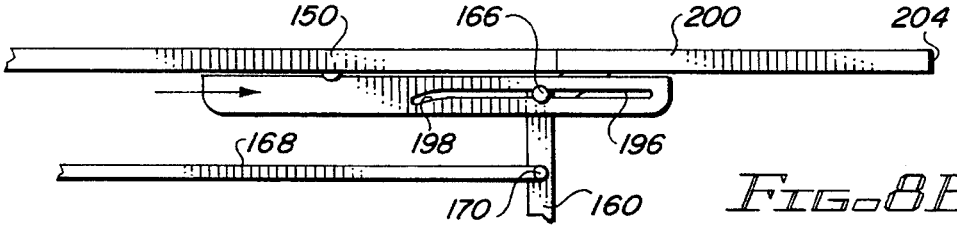
FIG. 8B is a side view sequentially following FIG. 8A.
Figure 8C:
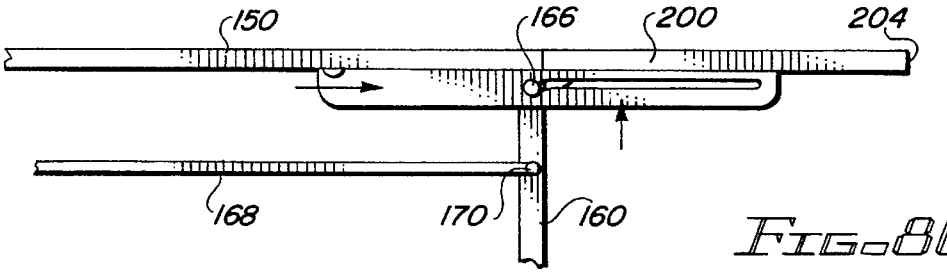
FIG. 8C is a side view sequentially following FIG. 8B.

FIGS. 8A, 8B, and 8C are sequentially side view illustrating the pivoting and locking of the extension or leaf plate 200 to the main table plate 150. FIG. 9 is a fragmentary view illustrating the elements involved in FIG. 8A. For the following discussion of the table apparatus 150, reference will primarily be made to FIGS. 5, 6, 7, 8A, 8B, 8C, and 9. Reference will be to the specific Figs. as appropriate.

The table apparatus 110 includes the main table plate 150 and the extension or leaf plate 200. The extension or leaf 200 is hingedly secured to the main table plate 150. The main table plate 150 is in turn secured to the base cabinet 12 through a base bracket assembly 120. The base bracket assembly includes a base plate 122 which is appropriately secured to the back panel 14 by a plurality of appropriate fastening elements, such as screws 132.

Extending outwardly from the base plate 122 is an arm 124 and an arm 134. The arms 124 and 134 are shown in FIG. 3, and details of the arm 124 are shown in FIGS. 5 and 7. The arms 124 and 134 include a pair of pivot pins, including lower pivot pins 126 and 136 and upper pivot pin 128 and 138, respectively.

The main table plate 150 includes a rear end 152 and a front end 156. A pair of pivot brackets is secured to the bottom of the main table plate 150 adjacent to the rear end 152. In FIG. 7, a pivot bracket 154 is shown secured to the main table plate 150 and pivotally secured to the arm 124 of the base bracket assembly 120 through the pivot pin 128. A bracket similar to the bracket 154 is secured to the main table plate 150 adjacent to the arm 134 of the base bracket assembly 120 and through the upper pivot pin 138 thereof.

The main table plate 150 pivots through its brackets on the upper pivot pins 128 and 138.

Adjacent to the front end 156 are two legs, including a leg 160 and a leg 180. The legs 160 and 170 are secured to each other by a cross member 172. The two brackets for the legs 160 and 180 are substantially identical and details of the hinge or pivot bracket 164 are shown in FIG. 9. The hinge bracket 164 is a generally u-shaped element with the base member secured to the bottom of the main table plate 150. The two arms or legs of the hinge bracket 164 extend outward. The upper portion of the leg 160 is disposed within the hinge bracket 164 and is secured therein by a pin 166. The pin 166 extends through the hinge bracket 164 and the leg 160.

The hinge bracket for the leg 180 is substantially identical to the hinge bracket 164 and the pin 166.

A pair of support members extend outwardly from the arms 124 and 134 of the base bracket assembly 120 to the legs 160 and 180. The support elements are pinned to the arms 124 and 134 at the lower pivot elements 128 and 138, respectively. A support element 168 is shown in FIGS. 1, 5, 7, and 8A, 8B, and 8C extending between the pivot element or pin 126 and the leg 160. The support member 168 pivots on a pivot pin 170 which extends through the leg 160.

As best shown in FIG. 5, as the main table plate pivots outwardly and downwardly from the cabinet 12, the support element or member 168 pivots on its pivot pins 126 and 170. The legs 160 and 170 pivot relative to the main plate 150 until they are substantially perpendicular to the main plate 150.

The extension or leaf plate 200 includes a rear end 202 and a front end 204. The rear end 202 is disposed adjacent to the front end 156 of the main plate 150. When the extension or leaf plate 200 is pivoted upwardly, as indicated in FIG. 8A, the rear end 202 is disposed adjacent to the front end 156 in a virtually abutting relationship. The extension or leaf plate 200 is locked in place relative to the main plate 150 by a pair of slider elements, including a slider element 190. The slider element 190 is shown in FIG. 8A, 8B, 8C, and 9. The slider element 190 is associated with the leg 160, and there is substantially identical, but mirror image slider element associated with the leg 180. The latter slider element is not shown.

The slider element 190 is a generally L-shaped member having two arms, an arm 192 and an arm 194. The arm 192 is appropriately pinned through a slot to the bottom side of the main table plate 150. A pin 193 is shown in FIG. 9. A slot 196 extends through the arm 194 of the slider element 190. The slot 196 includes a downwardly angled end portion 198. The pin 166 extends through the slot 196.

The extension or leaf plate 200 is secured to the main plate 150 through a hinge bracket 210. A pin 166 extends through the hinge bracket 210. The extension or leaf plate 200 accordingly is secured to the main plate 150, the leg 160, and the slider bracket 190 through the pin 166.

A second hinge bracket, not shown, is also pinned to the plate 160 and the leg 180 through a second hinge bracket, a mirror of the hinge bracket 210, as may be understood.

FIGS. 8A, 8B, and 8C show sequentially how the extension or leaf plate 200 slides pivoted upwardly against the front end 156 of the main table plate 150 and is held therein by the pair of slider elements, with the slider 190 shown in detail. When the extension or leaf plate 200 is pivoted upwardly, the extension or leaf plate 200 is moved outwardly, with the pin 193 extending through the arm 192 and the pin 166 extending through the slot 196. This is shown in FIG. 8B.

As the pin 166 moves into the downwardly angled end 198 of the slot 196, the front end of the slider element 190, disposed beneath the extension or leaf plate 200, is biased upwardly to lock the extension or leaf plate 200 in its abutting and aligned relationship with the main table plate 150.

To hold the table apparatus 110, the two slider elements, including the slider element 190 and its parallel companion adjacent to the leg 180, are moved rearwardly from beneath the leaf plate 200. The leaf plate 200 then is able to pivot downwardly against the legs 160 and 180. The table apparatus 110 is then moved upwardly, with the outer end 156 of the main plate 150 moved upwardly into the upper portion of the cabinet 12. The legs 160 and 180 pivot downwardly until they are beneath the bottom of the table plate 150, and adjacent thereto. This is best shown in FIG. 3.

To secure the table 110 within the cabinet 12, a lock assembly 220 is used. Details of the lock assembly are illustrated in FIG. 6. The lock assembly 220 includes a base plate or bracket 222 which is appropriately secured to the panel 22, as by screws. Extending downwardly from the base plate 222 are two arms, of which an arm 224 is shown in FIG. 6. Pivotally secured to the arm is a lock plate. A lock plate 230 is shown pivotally secured to the arm 224 by a pin 226. The lock 230 is of a generally rectangular configuration, with a bottom edge 232 and an outer end 234. At the juncture of the bottom edge 232 and the outer end 234 is a shoulder or step 236.

To lock the table apparatus 110 within the cabinet 12, the main table plate 150, with its extension or leaf plate 200 and the legs 160 and 180 folded downwardly, in a generally parallel relationship, and the plate 150 is moved into the cabinet 12. As the main plate 150 contacts the bottom edge 232 of the lock plate 230, the lock plate pivots upwardly on the pin 226 until the main plate 150 is disposed adjacent to the back panel 14. This is, of course, when the table apparatus 110 is fully disposed or nested within the cabinet 12. At such time as the outer end 156 of the main plate 150, and its bottom side passes into the shoulder of step 236, gravity causes the lock plate 232 to move downwardly. The outer end 156 is then within the shoulder or step 236, and is locked therein. The table apparatus 110 will remain in the position shown in FIG. 6, and also as shown in FIG. 3, until the lock plate 230, and its parallel, companion lock plate, are manually raised until the bottom surface 232 clears the end 156. At such time as the end 156 clears the bottom edge 232, the table apparatus 110 may pivot outwardly on the base bracket assembly 120, as discussed above. When the main plate 150 clears the cabinet 12, the two lock plates pivot downwardly under gravity and remain in the down position until the table apparatus 110 is again moved upwardly.

While the lock plate must be manually lifted to unlock the table apparatus from the cabinet 12, the camming action of the main plate 156 against the bottom edges of the lock plates causes the lock plates to raise automatically. Again, gravity caused the lock plate to move downwardly to lock the main plate 150, with the other elements secured thereto, within the cabinet 12.

With the table apparatus 110 disposed within the cabinet 12, as shown in FIG. 3, the doors 30 and 70 may be closed, as shown in FIG. 2.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Wall mounted table apparatus comprising in combination:

a base cabinet to be mounted on a wall and defining an enclosure;

a base plate secured to the base cabinet;

a first arm and a second arm pivotally secured to the base plate and spaced apart from each other;

a table plate secured to the first arm, the table plate having a rear end adjacent to the base plate and a front end remote from the rear end;

a leg pivotally secured to the table adjacent to the front end and also pivotally secured to the second arm;

an extension plate pivotally secured to the table plate at the front end;

a pin secured to the leg; and a slider element having a slot for receiving the pin and on which the slider element slides, the slot including a first portion generally parallel to the table and an angled portion for biasing the slider element against the table plate and the extension plate when the pin is disposed in the angled portion locking the extension plate in aligned relationship with the table plate.

2. The apparatus of claim 1 in which the slider element includes a first arm through which the slot extends and a second arm disposed against the table plate and the extension plate.

* * * * *